US010224137B2

(12) United States Patent
Shiki et al.

(10) Patent No.: US 10,224,137 B2
(45) Date of Patent: Mar. 5, 2019

(54) ELECTROMAGNET CONTROL APPARATUS

(71) Applicants: DYDEN CORPORATION, Fukuoka (JP); TAGUCHI INDUSTRIAL CO., LTD., Okayama (JP)

(72) Inventors: Hidenobu Shiki, Fukuoka (JP); Yuta Yasumatsu, Fukuoka (JP); Yuichi Taguchi, Okayama (JP)

(73) Assignees: DYDEN CORPORATION, Fukuoka (JP); TAGUCHI INDUSTRIAL CO., LTD., Okayama (JP)

( * ) Notice: Subject to any disclaimer, the term of this patent is extended or adjusted under 35 U.S.C. 154(b) by 300 days.

(21) Appl. No.: 15/343,993

(22) Filed: Nov. 4, 2016

(65) Prior Publication Data

US 2017/0125146 A1 May 4, 2017

(30) Foreign Application Priority Data

Nov. 4, 2015 (JP) ..... 2015-216924

(51) Int. Cl.
*H01F 7/06* (2006.01)
*B66C 1/08* (2006.01)
*H01F 7/20* (2006.01)

(52) U.S. Cl.
CPC ..... *H01F 7/064* (2013.01); *B66C 1/08* (2013.01); *H01F 7/206* (2013.01)

(58) Field of Classification Search
CPC ..... H01F 7/064; H01F 7/206; B66C 1/08
USPC ..... 361/152
See application file for complete search history.

(56) References Cited

FOREIGN PATENT DOCUMENTS

JP 11071085 A * 3/1999
JP 2007-119160 A 5/2007

OTHER PUBLICATIONS

Machine Translation of Iwamoto Japanese Patent Document JP 11071085 A, Mar. 16, 1999.*

* cited by examiner

*Primary Examiner* — Kevin J Comber
(74) *Attorney, Agent, or Firm* — Michael Best & Friedrich LLP

(57) ABSTRACT

There is provided an electromagnet control apparatus that continuously attracts crushed pieces of metals with the core of a magnetized electromagnet without immediately releasing the attracted pieces in a composite operation of a construction machine. The electromagnet control apparatus includes a control unit that controls a demagnetized state, a magnetized state, or a counter-magnetized state of an electromagnet. Until the end of a first threshold time $t_{th1}$ from a transition to the demagnetized state from the magnetized state, the control unit ignores a turn-on voltage for turning on first transistors (a first transistor, a fourth transistor) and turns on the first transistors after a lapse of a second threshold time that is shorter than the first threshold time. The demagnetized state and the magnetized state are repeated until the end of the first threshold time $t_{th1}$ from the transition to the demagnetized state.

6 Claims, 6 Drawing Sheets

ELECTROMAGNET CONTROL APPARATUS

BACKGROUND OF THE INVENTION

Field of the Invention

The present invention relates to an electromagnet control apparatus that controls current to an electromagnet mounted in a construction machine.

Description of the Related Art

A conventional lifting magnet driving circuit includes a direct-current conversion unit that converts an alternating power supply voltage into a direct-current power supply voltage, an H-bridge circuit that controls the direction of magnetizing current to a lifting magnet, an energy absorption unit that has a transistor and a resistance element connected to each other in series and a capacitor connected in parallel with the transistor and the resistance element, the energy absorption unit absorbing energy accumulated in the lifting magnet when the direction of magnetizing current is changed, and a control unit that controls continuity in the transistor of the energy absorption unit based on the direction and amplitude of current passing through a positive-side power supply line between the H-bridge circuit and the energy absorption unit and a potential difference between the positive-side power supply line and a negative-side power supply line (for example, see Japanese Patent Laid-Open No. 2007-119160).

If the arm or the like of a construction machine is operated during the control of the lifting magnet (hereinafter, will be called a composite operation), unfortunately, the conventional lifting magnet driving circuit reduces the flow rate of oil supplied to the power generator of a construction machine and reduces a voltage applied across the lifting magnet. This may cause the control unit to change a control state from magnetization to counter-magnetization (demagnetization) regardless of the intention of an operator so as to release pieces of iron attracted to the lifting magnet.

The present invention has been devised to solve the problem and provides an electromagnet control apparatus that can suppress a change of a control state from magnetization to counter-magnetization by a control unit regardless of the intention of an operator during a composite operation of a construction machine.

SUMMARY OF THE INVENTION

An electromagnet control apparatus according to the present invention is an electromagnet control apparatus that controls a current to an electromagnet, the electromagnet control apparatus being disposed in a construction machine that is started by operating a hydraulically operating unit with an operating part, the electromagnet control apparatus including: a rectifier connected to the generator that generates power according to a hydraulic pressure of the hydraulically operating unit of the construction machine and configured to convert an alternating voltage applied from a generator into a direct-current voltage; an H-bridge circuit configured to switch the direction of current to the electromagnet, the H-bridge circuit including four transistors and four semiconductor diodes that are respectively connected to the four transistors between two current-controlling terminals of three terminals of the respective transistors with a forward direction opposite to the direction of a current flowing through the transistors; a capacitor connected in parallel between the rectifier and the H-bridge circuit and configured to accumulate an electric charge of the direct-current voltage and an electric charge of a counter electromotive force from a coil of the electromagnet; and a control unit that controls a demagnetized state of the electromagnet in which the four transistors of the H-bridge circuit are turned off, a magnetized state of the electromagnet in which first transistors including two of the transistors are turned on, the two transistors being diagonal to each other in the H-bridge circuit, and second transistors including the other two transistors diagonal to each other are turned off, or a counter-magnetized state of the electromagnet in which the first transistors are turned off and the second transistors are turned on, wherein until the end of a first threshold time from a transition to the demagnetized state from the magnetized state, the control unit ignores a turn-on voltage for turning on the first transistors and turns on the first transistors after a lapse of a second threshold time that is shorter than the first threshold time, and the demagnetized state and the magnetized state are repeated until the end of the first threshold time from the transition to the demagnetized state.

The electromagnet control apparatus of the present disclosure can continuously attract crushed pieces of metals with the core of the magnetized electromagnet without immediately releasing the attracted pieces in a composite operation of the construction machine.

DETAILED DESCRIPTION OF THE PREFERRED EMBODIMENT

First Embodiment of the Present Invention

Figure 1:
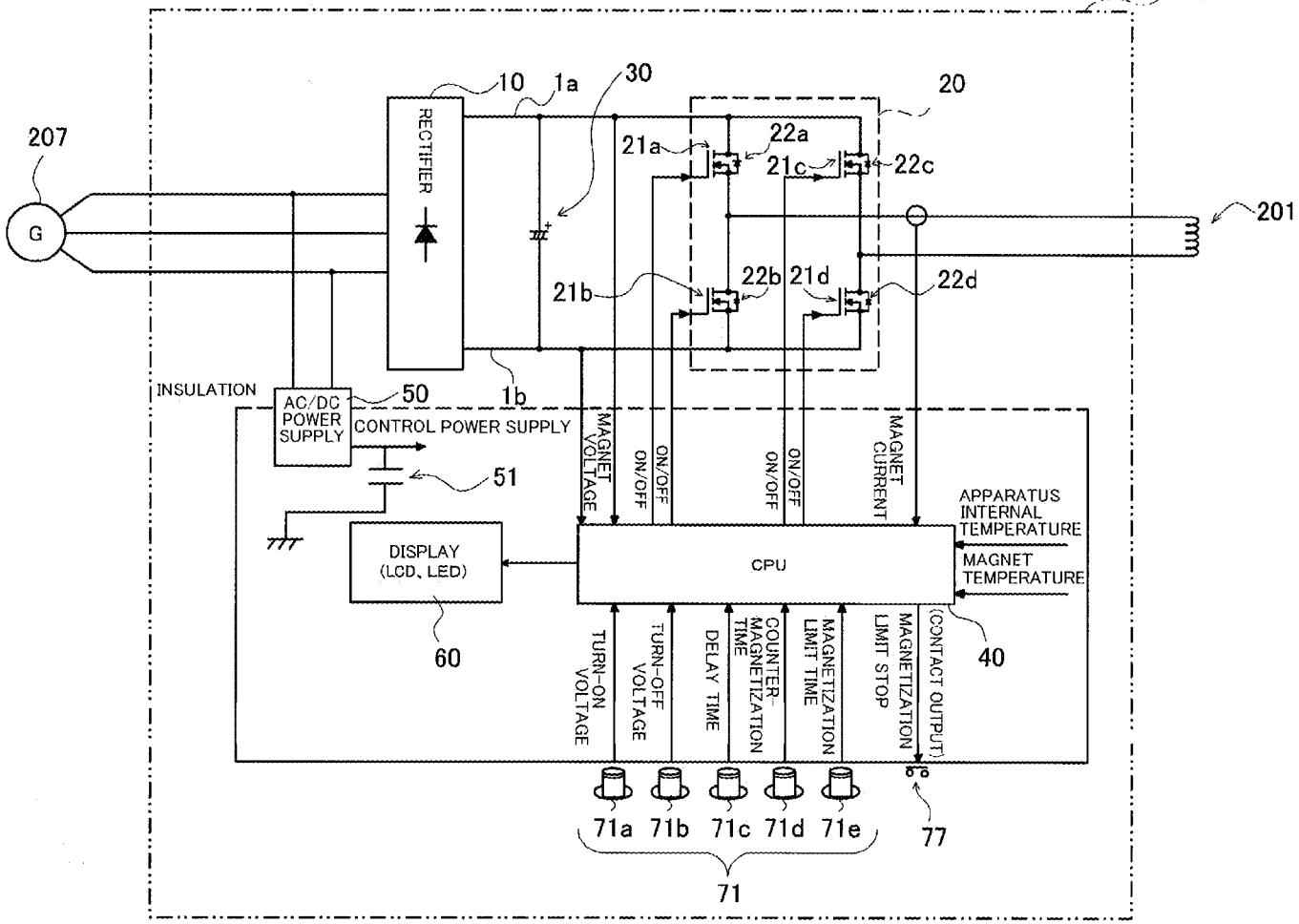
FIG. 1 is a basic block-circuit diagram showing the schematic configuration of an electromagnet control apparatus according to an embodiment of the present invention.
Figure 2A:
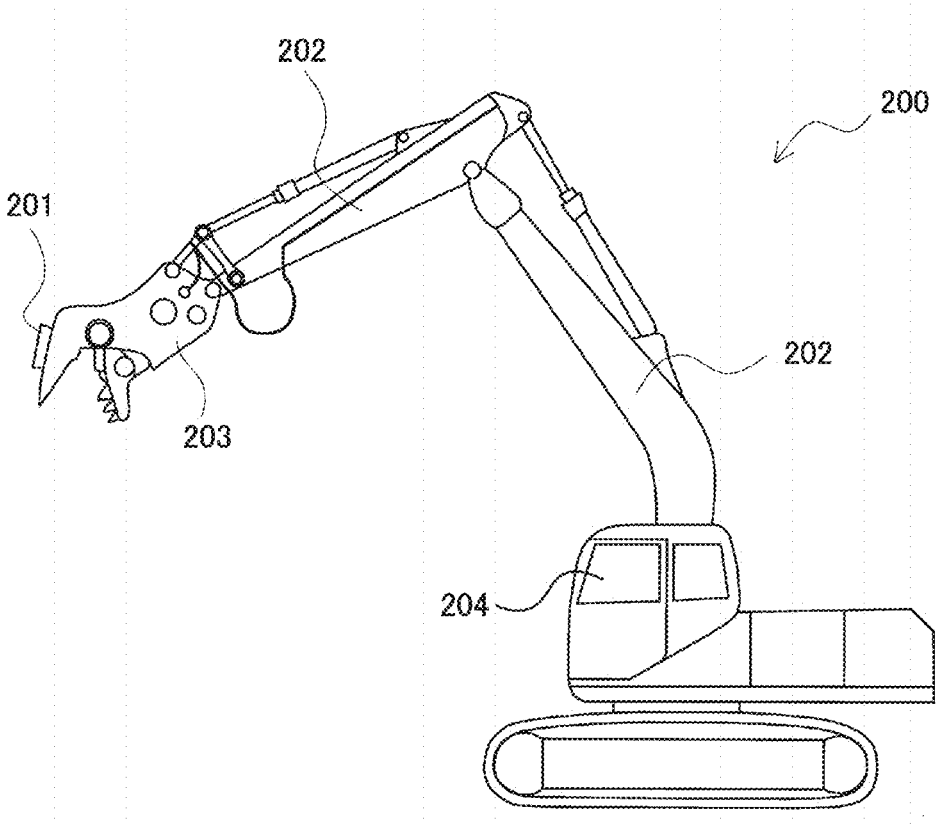
FIG. 2A is a side view showing the schematic configuration of a construction machine.
Figure 2B:
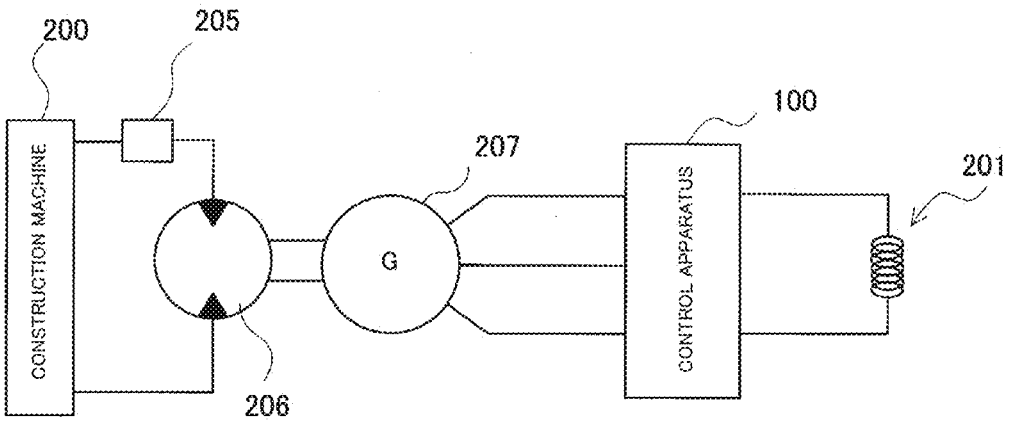
FIG. 2B is an explanatory drawing showing a connected state of the construction machine and the electromagnet control apparatus.

As shown in FIGS. 1 to 3, an electromagnet control apparatus 100 according to an embodiment of the present invention includes a main circuit (a rectifier 10, an H-bridge circuit 20, and a capacitor 30) and a control circuit (a control unit 40, an AC/DC power supply 50, a display 60, and an adjustment knob 71) that are contained in a housing 70. The electromagnet control apparatus 100 controls a current to an electromagnet 201 disposed on a construction machine 200. Electrical isolation is provided between the main circuit and the control circuit in the housing 70.

As shown in FIG. 2A, the construction machine 200 is, for example, a hydraulic excavator. The electromagnet 201 is disposed on an attachment (e.g., a crusher 203) mounted on the distal end of an arm 202 of the hydraulic excavator.

In the construction machine 200, an operator in a cab 204 of the construction machine 200 operates an operating part (e.g., a control lever) to control the hydraulic unit (including a flow control valve 205 and a hydraulically operating unit (hydraulic motor) 206) of the construction machine 200, turning on or off a generator 207 that generates power according to a hydraulic pressure of the hydraulic motor 206. Typically, the construction machine 200 turns on the power supply to start magnetization of the electromagnet 201, allowing the electromagnet 201 to attract crushed pieces (hereinafter, will be referred to as "attracted pieces") including metals, whereas the construction machine 200 turns off the power supply to discard (release) the attracted pieces.

The construction machine 200 is an existing machine and the explanation of the hydraulic system and control of the construction machine 200 is omitted.

As shown in FIG. 1, the rectifier 10 is connected to the generator 207 of the construction machine 200 and converts an alternating voltage applied from the generator 207 into a direct-current voltage. The rectifier 10 of the present embodiment is a three-phase full wave rectifying circuit including six rectifier cells that full-wave rectify all the phases of the three-phase generator 207.

The H-bridge circuit 20 includes four transistors 21 (a first transistor 21*a*, a second transistor 21*b*, a third transistor 21*c*, and a fourth transistor 21*d*) and four semiconductor diodes 22 (a first diode 22*a*, a second diode 22*b*, a third diode 22*c*, and a fourth diode 22*d*) that are respectively connected to the four transistors 21 between two current-controlling terminals of three terminals of the respective transistors 21 with a forward direction opposite to the direction of a current flowing through the transistors 21. This configuration switches the direction of current to the electromagnet 201.

The transistor 21 of the present embodiment is an N-channel insulated gate field-effect transistor (IGFET) of an enhancement type with a single gate and a substrate internally connected to the source of the transistor.

However, the transistor 21 is not limited to the FET as long as a current across the two terminals is controlled. For example, a junction FET or a bipolar transistor may be used.

The cathode of the semiconductor diode 22 of the present embodiment is connected to the drain of the FET and the anode of the semiconductor diode 22 is connected to the source of the FET.

The capacitor 30 is connected in parallel between the rectifier 10 and the H-bridge circuit 20. The capacitor 30 accumulates the electric charge of a direct-current voltage from the rectifier 10 and the electric charge (energy) of a counter electromotive force from the coil of the electromagnet 201. The capacitor 30 of the present embodiment is a large-capacitance electrolytic capacitor and also acts as a leveling and counter-magnetizing power supply for a direct-current voltage from the rectifier 10.

The control unit 40 controls a demagnetized state of the electromagnet 201 in which the four transistors 21 (the first transistor 21*a*, the second transistor 21*b*, the third transistor 21*c*, and the fourth transistor 21*d*) of the H-bridge circuit 20 are turned off, a magnetized state of the electromagnet 201 in which first transistors including two of the transistors 21 (the first transistor 21*a*, the fourth transistor 21*d*) are turned on, the two transistors being diagonal to each other in the H-bridge circuit 20 and second transistors including the two other transistors (the second transistor 21*b*, the third transistor 21*c*) diagonal to each other are turned off, or a counter-magnetized state of the electromagnet 201 in which the first transistors (the first transistor 21*a*, the fourth transistor 21*d*) are turned off and the second transistors (the second transistor 21*b*, the third transistor 21*c*) are turned on.

Specifically, the control unit 40 monitors a direct-current voltage (hereinafter, will be referred to as "magnet voltage $V_{mag}$") applied to the electromagnet 201 (H-bridge circuit 20) and controls on/off of the first transistors (the first transistor 21*a*, the fourth transistor 21*d*) of the H-bridge circuit 20 and the second transistors (the second transistor 21*b*, the third transistor 21*c*) of the H-bridge circuit 20 based on the voltage value of the magnet voltage $V_{mag}$.

Moreover, the control unit 40 also monitors a current passing through the electromagnet 201 (hereinafter, will be referred to as "magnet current"), a temperature in the electromagnet control apparatus 100, and a temperature of the electromagnet 201. The first and second transistors of the H-bridge circuit 20 may be controlled so as to be turned on or off based on these values.

In the control unit 40 of the present embodiment, a microcomputer (CPU: central processing unit) is used. The microcomputer is driven so as to control the electromagnet control apparatus 100 at a voltage (hereinafter, will be referred to as "control-on voltage" $V_s$) that is preset as a fixed value (e.g., 70 V).

Moreover, in the control unit 40 of the present embodiment, the electromagnet 201 shifts to a magnetized state at a voltage (hereinafter, will be referred to as "turn-on voltage $V_{on}$") that is set as an adjusted value (e.g., 160 V to 210 V (the minimum setting unit is 1 V)). The turn-on voltage $V_{on}$ can be adjusted by the adjustment knob 71 (turn-on voltage setting volume 71*a*).

Furthermore, in the control unit 40 of the present embodiment, the electromagnet 201 shifts to a delayed state (a demagnetized state after the end of a magnetized state) or a counter-magnetized state at a voltage (hereinafter, will be referred to as "turn-off voltage $V_{off}$") that is set as an adjusted value (e.g., 150 V to 200 V (the minimum setting unit is 1V), turn-on voltage $V_{on} \geq$ turn-off voltage $V_{off}$+10 V). The turn-off voltage $V_{off}$ can be adjusted by the adjustment knob 71 (turn-off voltage setting volume 71*b*).

In the control unit 40 of the present embodiment, a time (hereinafter, will be referred to as "delay time") from the end of a magnetized state (the beginning of a demagnetized state) to the end of a demagnetized state is set as an adjusted value (e.g., 0 to 10 seconds (the minimum setting unit is 0.1 seconds)). The delay time can be adjusted by the adjustment knob 71 (delay-time setting volume 71*c*).

Furthermore, in the control unit 40 of the present embodiment, a time (hereinafter, will be referred to as "counter-magnetization time") from the end of a demagnetized state (the beginning of a counter-magnetized state) to the end of a counter-magnetized state is set as an adjusted value (e.g., 0 to 5 seconds (the minimum setting unit is 0.1 seconds)). The counter-magnetization time can be adjusted by the adjustment knob 71 (counter-magnetization time setting volume 71*d*).

Moreover, in the control unit 40 of the present embodiment, a time for limiting a magnetized state (hereinafter, will be referred to as "magnetization limit time") is set as an adjusted value (e.g., three to ten minutes (the minimum setting unit is one minute)). The magnetization limit time can be adjusted by the adjustment knob 71 (magnetization limit-time setting volume 71*e*).

After a lapse of a first threshold time $t_{th1}$ (hereinafter, will be referred to as "switching monitoring time $t_{th1}$") from a transition from a magnetized state to a demagnetized state, the control unit 40 turns on the first transistors (the first transistor 21*a*, the fourth transistor 21*d*) if the magnet voltage $V_{mag}$ applied to the electromagnet 201 is equal to or higher than a predetermined threshold voltage $V_{th}$ (hereinafter, will be referred to as "switching voltage $V_{th}$"), and the control unit 40 turns on the second transistors (the second transistor 21*b*, the third transistor 21*c*) if the magnet voltage $V_{mag}$ is lower than the switching voltage $V_{th}$.

The switching monitoring time $t_{th1}$ of the present embodiment is set at 0 to 9.9 seconds and can be adjusted in tenths of a second by the magnetization limit-time setting volume 71*e*. However, if the switching monitoring time $t_{th1}$ is set at 0 second, the control unit 40 does not monitor the switching monitoring time $t_{th1}$ (compare the magnet voltage $V_{mag}$ with the switching voltage $V_{th}$).

The switching monitoring time $t_{th1}$ in particular is preferably set at a time (e.g., 1 second) that allows continuous attraction for pieces to the electromagnet 201.

The switching voltage $V_{th}$ of the present embodiment is set at 50 to 200 V and can be adjusted in volts by the delay-time setting volume 71*c*.

The switching voltage $V_{th}$ in particular is set higher than the turn-off voltage $V_{off}$ (e.g., 170 V) for turning off the first transistors (the first transistor 21*a*, the fourth transistor 21*d*) and lower than the turn-on voltage $V_{on}$ (e.g., 185 V) for turning on the first transistors (the first transistor 21*a*, the fourth transistor 21*d*).

From a transition to a demagnetized state to the lapse of the switching monitoring time $t_{th1}$, the control unit 40 ignores the turn-on voltage $V_{on}$ for turning on the first transistors (the first transistor 21*a*, the fourth transistor 21*d*). The control unit 40 turns on the first transistors (the first transistor 21*a*, the fourth transistor 21*d*) after a lapse of a second threshold time $t_{th2}$ (hereinafter, will be referred to as "energy collection time $t_{th2}$") that is shorter than the switching monitoring time $t_{th1}$.

The energy collection time $t_{th2}$ is a time period required for substantially fully collecting the energy of a counter electromotive force from the coil of the electromagnet 201 by the capacitor 30 (a time that allows the capacitor 30 to accumulate the electric charge of a counter electromotive force from the coil of the electromagnet 201) during a transition from a magnetized state to a demagnetized state. The energy collection time $t_{th2}$ is set at, for example, 200 ms.

The AC/DC power supply 50 is connected between the generator 207 and the rectifier 10. The AC/DC power supply 50 converts alternating-current power applied from the generator 207 into direct-current power and supplies power to the control unit 40 as a control power supply through the capacitor 51 acting as a leveling and backup power supply for direct-current voltage.

The display 60 includes a light emitting diode (LED) 61 that indicates a state (a control on-state, a magnetized state, a delayed state, a counter-magnetized state, an alarm, a setting, a setting error) of the electromagnet control apparatus 100 based on a control signal from the control unit 40, and a liquid crystal display (LCD) 62 that displays set values (a magnet voltage, a magnet current, a turn-on voltage, a turn-off voltage, a delay time, a counter-magnetization time, a magnetization limit time, abnormality information).

Figure 3A:
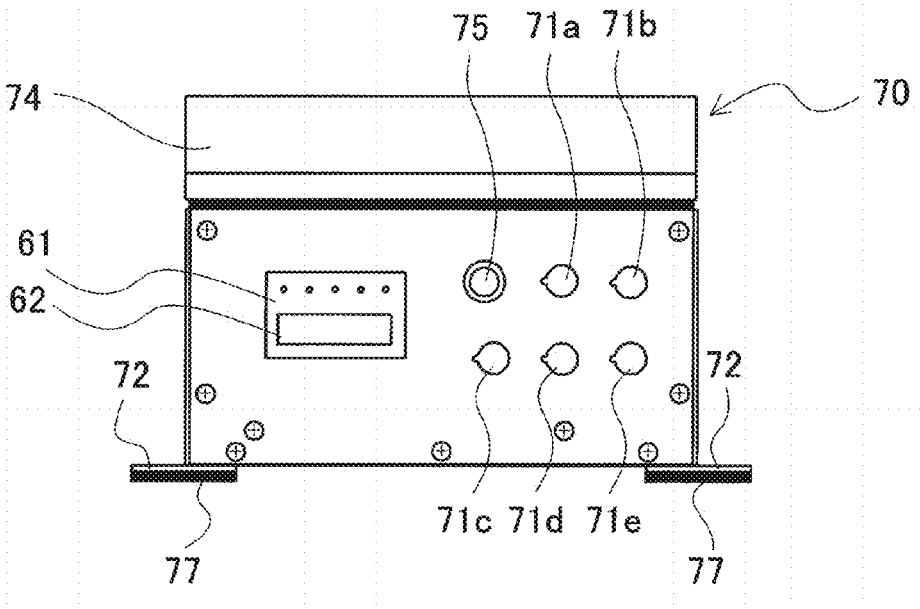
FIG. 3A is a front view showing the schematic configuration of the housing of the electromagnet control apparatus shown in FIG. 1.
Figure 3B:
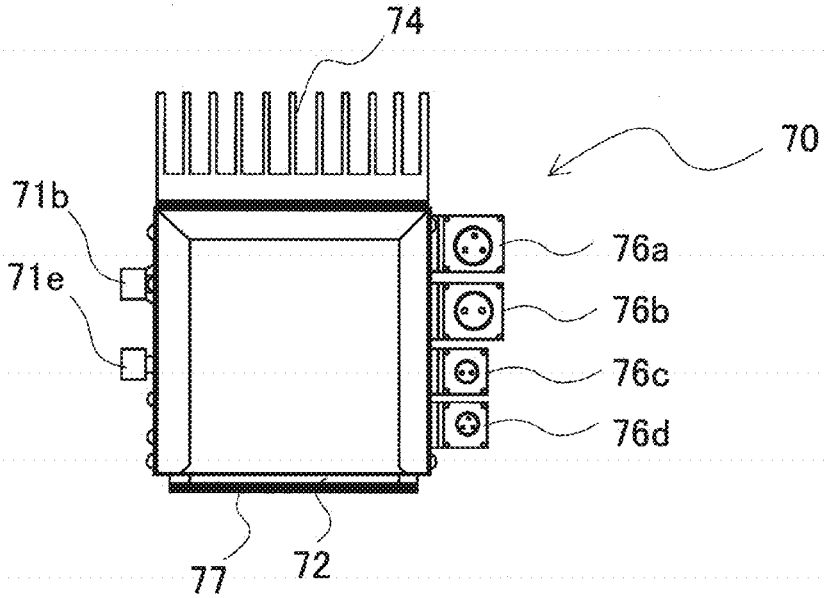
FIG. 3B is a right side view of the housing shown in FIG. 3A.
Figure 3C:
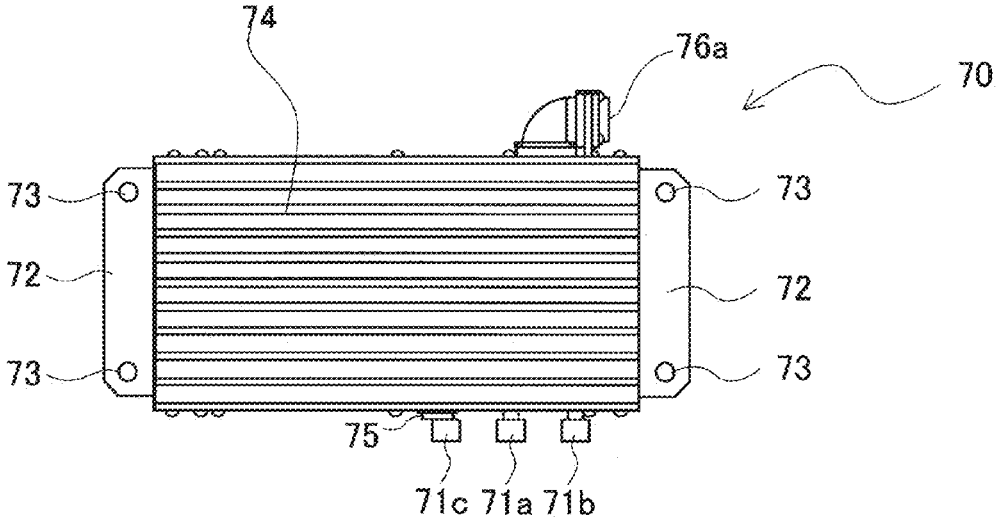
FIG. 3C is a plan view of the housing shown in FIG. 3A.

As shown in FIGS. 3A to 3C, the housing 70 includes metallic mounting stays 72 for fixing the electromagnet control apparatus 100 to the construction machine 200, mounting bolt holes 73 for fixing the electromagnet control apparatus 100 to the construction machine 200, a heatsink 74 for releasing heat generated in the electromagnet control apparatus 100 to the outside, an operation/setting switching button 75 for switching the operation/setting mode of the electromagnet control apparatus 100, a power input connector 76*a* for receiving power from the generator 207, a power output connector 76*b* for outputting power to the electromagnet 201, a contact output connector 76*c* for outputting a contact to the outside, a dummy connector 76*d* to be unused, and rubber vibration isolators 77 made of ethylene propylene rubber (EPDM).

The housing 70 includes, as the adjustment knob 71, the turn-on voltage setting volume 71*a* for setting a voltage (turn-on voltage $V_{on}$) where the electromagnet 201 shifts to a magnetized state, the turn-off voltage setting volume 71*b* for setting a voltage (turn-off voltage $V_{off}$) where the electromagnet 201 shifts to a delayed state or a counter-magnetized state, the delay-time setting volume 71*c* for setting a delay time, the counter-magnetization time setting volume 71*d* for setting a counter-magnetization time, and the magnetization limit-time setting volume 71*e* for setting a magnetization time.

Figure 4:
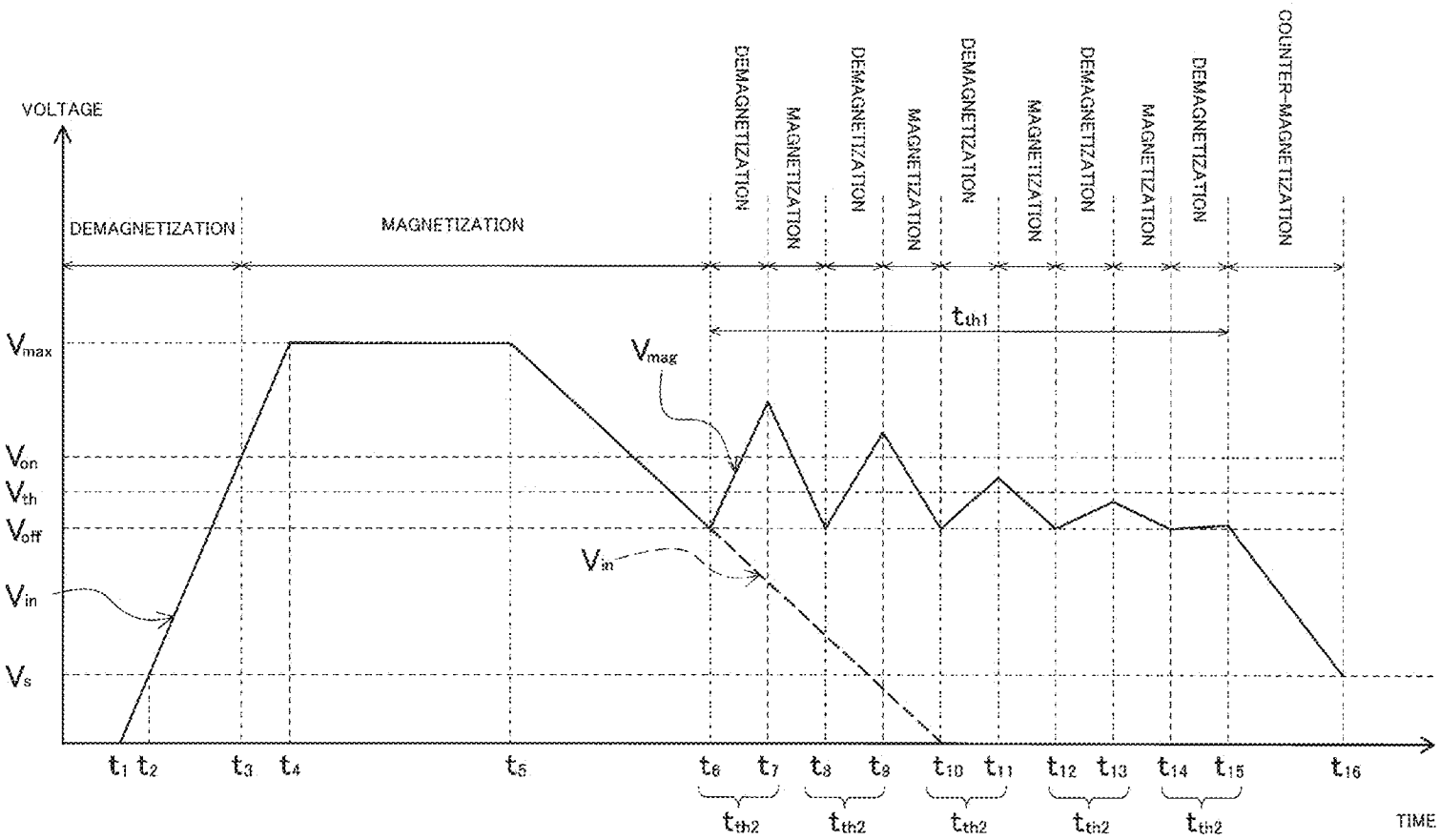
FIG. 4 is an explanatory drawing showing an example of a control pattern of the electromagnet control apparatus shown in FIG. 1.
Figure 5:
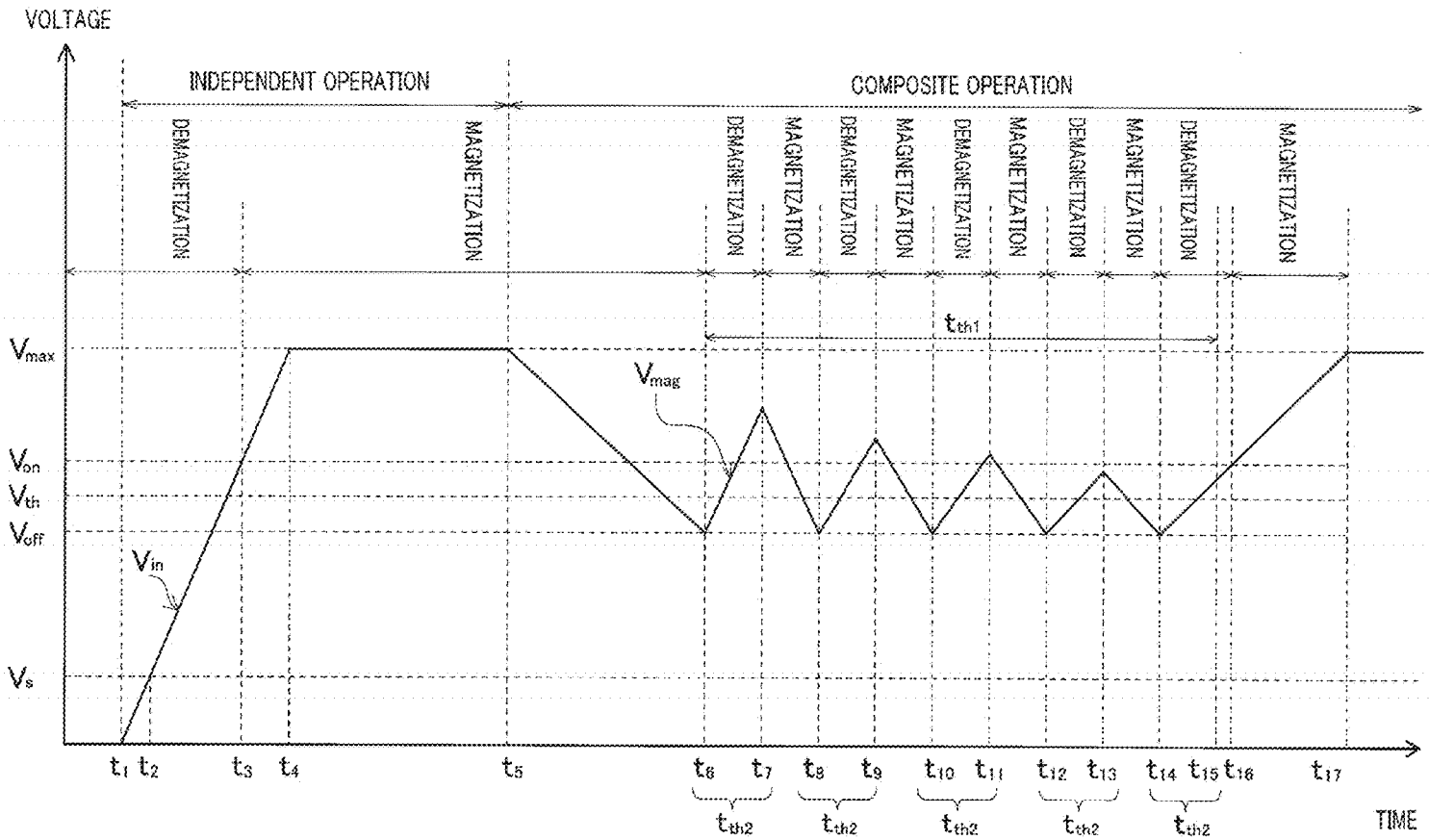
FIG. 5 is an explanatory drawing showing another example of the control pattern of the electromagnet control apparatus shown in FIG. 1.

Referring to FIGS. 4 and 5, the processing operation of the electromagnet control apparatus 100 will be discussed below.

Referring to FIG. 4, a series of operations for attracting pieces (magnetizing the electromagnet 201) and releasing the attracted pieces (counter-magnetizing the electromagnet 201) will be discussed below, in an independent operation for controlling only magnetization (counter-magnetization, demagnetization) of the electromagnet 201 without operating, for example, the arm 202 of the construction machine 200.

Before the operator of the construction machine 200 starts the operations, the transistors 21 (the first transistor 21*a*, the second transistor 21*b*, the third transistor 21*c*, and the fourth transistor 21*d*) of the H-bridge circuit 20 are turned off (the electromagnet 201 is demagnetized).

The operator operates the control lever of the construction machine 200 at time $t_1$ so as to control the hydraulic unit, rotate the hydraulic motor 206, and drive the generator 207.

The generator 207 supplies three-phase alternating-current power to the electromagnet control apparatus 100.

The rectifier 10 of the electromagnet control apparatus 100 converts an alternating input voltage (hereinafter, will be referred to as "generator voltage $V_{in}$") from the generator 207 into a direct-current output voltage (magnet voltage $V_{mag}$), the alternating input voltage being generated by rotating the hydraulic motor 206. The magnet voltage $V_{mag}$ is applied between a positive-side power supply line 1*a* and a negative-side power supply line 1*b*.

In this case, the transistors 21 (the first transistor 21*a*, the second transistor 21*b*, the third transistor 21*c*, and the fourth transistor 21*d*) are turned off in the H-bridge circuit 20. The cathode sides of the semiconductor diodes 22 (the first diode 22*a*, the second diode 22*b*, the third diode 22*c*, and the fourth diode 22*d*) are connected to the positive-side power supply line 1*a* and a current does not pass through the semiconductor diode 22. Thus, a magnet current does not pass through the electromagnet 201 kept in a demagnetized state.

The capacitor 30 accumulates electric charge generated by the magnet voltage $V_{mag}$.

The AC/DC power supply 50 of the electromagnet control apparatus 100 converts alternating-current power (generator voltage $v_{in}$) to direct-current power and supplies the direct-current power to the control unit 40 as a control power supply (control voltage $V_c$).

The generator voltage $v_{in}$ (control voltage $V_c$) from the generator 207 gradually increases to the control-on voltage $V_s$ at time $t_2$. At this point, the control unit 40 starts driving to monitor the magnet voltage $V_{mag}$.

The generator voltage $v_{in}$ (control voltage $V_c$) from the generator 207 further increases from the control-on voltage $V_s$ at time $t_2$ to the turn-on voltage $V_{on}$ at time $t_3$. At this point, the control unit 40 turns on (applies the gate voltage of the FET) the first transistors (the first transistor 21*a*, the fourth transistor 21*d*). Thus, the magnet current passes from the rectifier 10 through the positive-side power supply line 1*a*, the drain and source of the first transistor 21*a*, the electromagnet 201, the drain and source of the fourth transistor 21*d*, and the negative-side power supply line 1*b* and flows into the rectifier 10. This magnetizes the coil of the electromagnet 201 and attracts pieces.

The generator voltage $v_{in}$ (control voltage $V_c$) from the generator 207 further increases from the turn-on voltage $V_{on}$ at time $t_3$ to a maximum value and is kept at a constant voltage $V_{max}$.

Subsequently, the operator operates the control lever of the construction machine 200 at time $t_5$ in order to release (discard) pieces attracted on the electromagnet 201. This controls the hydraulic unit, stops the rotation of the hydraulic motor 206, and stops driving the generator 207.

The generator voltage $v_{in}$ (control voltage $V_c$) from the generator 207 gradually decreases in response to a stop of the generator 207 and reaches the turn-off voltage $V_{off}$ at time $t_6$. At this point, the control unit 40 turns off (does not apply the gate voltage of the FET) the first transistors (the first transistor 21*a*, the fourth transistor 21*d*).

This prevents the magnet current from passing through the coil of the electromagnet 201, placing the electromagnet 201 into a demagnetized state. The pieces are continuously attracted without being immediately released because the attracted pieces are affected by the hysteresis of the core of the electromagnet 201 (the magnetic force of the magnetized core is not eliminated in a short time).

Energy accumulated in the coil of the electromagnet 201 generates a counter electromotive force for the coil of the electromagnet 201 such that the counter electromotive force of the coil keeps a current. The energy passes a current through the first diode 22*a* acting as a flywheel diode (a reflux diode, a regenerative diode) and accumulates electrical charge in the capacitor 30.

As indicated by a broken line in FIG. 4, the generator voltage $v_{in}$ from the generator 207 continuously decreases from time $t_6$ because the generator 207 is stopped. As indicated by a solid line in FIG. 4, the magnet voltage $V_{mag}$ is increased from time $t_6$ by the counter electromotive force of the coil of the electromagnet 201.

From time $t_6$, the control unit 40 starts measuring the switching monitoring time $t_{th1}$ and the energy collection time $t_{th2}$. Even if the magnet voltage $V_{mag}$ exceeds the turn-on voltage $V_{on}$ before the end of the energy collection time $t_{th2}$, electric charge is continuously accumulated in the capacitor 30 by the counter electromotive force of the coil of the electromagnet 201 without turning on the first resistors (the first transistor 21*a*, the fourth transistor 21*d*).

After a lapse of the energy collection time $t_{th2}$ ($t_7-t_6=200$ ms), the control unit 40 turns on the first transistors (the first transistor 21*a*, the fourth transistor 21*d*) and the magnetized state of the electromagnet 201 is started by electric charge accumulated in the capacitor 30.

Since power is not supplied from the stopped generator 207, the voltage of the capacitor 30 gradually decreases.

When the voltage of the capacitor reaches the turn-off voltage $V_{off}$ at time $t_8$, the control unit 40 turns off (does not apply the gate voltage of the FET) the first transistors (the first transistor 21*a*, the fourth transistor 21*d*). This prevents the magnet current from passing through the coil of the electromagnet 201, placing the electromagnet 201 into a demagnetized state.

Until the end of the switching monitoring time $t_{th1}$, the demagnetized state (accumulation of the capacitor 30) and the magnetized state (discharging of the capacitor 30) of the energy collection time $t_{th2}$ are similarly repeated. In this case, the energy collection time $t_{th2}$ is kept constant but energy accumulated in the coil of the electromagnet 201 decreases with the passage of time. Thus, a maximum value of the magnet voltage $V_{mag}$ at the end of the energy collection time $t_{th2}$ gradually decreases.

At the end of the switching monitoring time $t_{th1}$, the control unit 40 compares the magnet voltage $V_{mag}$ and a switching voltage $v_{th}$. Since the magnet voltage $V_{mag}$ is lower than the switching voltage $v_{th}$, the control unit 40 turns on the second transistors (the second transistor 21*b*, the third transistor 21*c*).

Thus, the magnet current passes from the capacitor 30 through the positive-side power supply line 1*a*, the drain and source of the third transistor 21*c*, the electromagnet 201, the drain and source of the third transistor 21*c*, and the negative-side power supply line 1*b* and then flows into the capacitor 30. This counter-magnetizes the coil of the electromagnet 201 and releases the attracted pieces.

Referring to FIG. 5, a series of operations for attracting pieces (magnetizing the electromagnet 201) will be discussed below, in a composite operation for operating, for example, the arm 202 of the construction machine 200 (for example, vertically moving the arm 202) during the attraction for pieces (magnetization of the electromagnet 201).

In the following explanation, the operator operates the arm 202 of the construction machine 200 at time $t_5$ in FIG. 5, allowing the construction machine 200 to start the composite operation.

The operations (independent operations) of the electromagnet control apparatus 100 and the construction machine 200 from time $t_1$ to time $t_5$ in FIG. 5 are similar to that (independent operation) of FIG. 4 and thus the explanation thereof is omitted.

Table 1 shows the measurement results of the generator voltage $v_{in}$ and the magnet voltage $V_{mag}$ when the construction machine 200 is shifted from an independent operation to a composite operation in an actual machine test of the construction machine 200.

TABLE 1

| Item | Independent operation | Composite operation |
|---|---|---|
| Frequency of generator voltage $v_{in}$ | 600 (Hz) | 240 (Hz) |
| Generator voltage $v_{in}$ (V phase) | AC160 (V) | AC75 (V) |
| Magnet voltage $V_{mag}$ | DC200 (V) | DC45 (V) |

As shown in Table 1, when the construction machine 200 shifts from the independent operation to the composite operation, a quantity of oil used for the electromagnet 201 decreases to about 40% of that in the independent operation according a change of the frequency of the generator voltage $v_{in}$ (the voltage waveform of the generator 207).

Consequently, in the composite operation of the construction machine 200, the generator voltage $v_{in}$ decreases to about 75 V(AC) while the magnet voltage $V_{mag}$ decreases to about 45 V(DC).

The generator voltage $v_{in}$ and the magnet voltage $V_{mag}$ reach the minimum voltages about 1 second after the start of the composite operation of the construction machine 200. Furthermore, it takes about 2 seconds (about 3 seconds after the start of the composite operation) to restore the generator voltage $v_{in}$ and the magnet voltage $V_{mag}$ to the voltages in the independent operation.

Under control conditions where a magnetized state and a demagnetized state are repeated, attracted pieces did not fall even in the composite operation of the construction machine 200.

In a composite operation of the construction machine 200, particularly, the generator voltage $v_{in}$ does not decrease to 0 V unlike in the case where an operator intentionally stops attraction for pieces on the electromagnet 201. Moreover, the maximum value of the magnet voltage $V_{mag}$ does not rapidly decrease from time $t_6$ unlike in the case where an operator intentionally stops attraction for pieces on the electromagnet 201.

Subsequently, the operator operates the control lever of the construction machine 200 at time $t_5$ in order to operate the arm 202 of the construction machine 200. This controls the hydraulic unit and uses a part of an oil pressure for the operation of the arm 202.

The generator voltage $v_{in}$ (control voltage $V_c$) from the generator 207 gradually decreases with a reduction in the quantity of oil used for the electromagnet 201. When the generator voltage $v_{in}$ reaches the turn-off voltage $V_{off}$ at time $t_6$, the control unit 40 turns off (does not apply the gate voltage of the FET) the first resistors (the first transistor 21*a*, the fourth transistor 21*d*).

This prevents the magnet current from passing through the coil of the electromagnet 201, placing the electromagnet 201 into a demagnetized state.

Energy accumulated in the coil of the electromagnet 201 generates a counter electromotive force for the coil of the electromagnet 201, passes a current through the first diode 22*a*, and accumulates electric charge in the capacitor 30.

The control unit 40 starts measuring the switching monitoring time $t_{th1}$ and the energy collection time $t_{th2}$ from time $t_6$. Until the end of the energy collection time $t_{th2}$, even if the magnet voltage $V_{mag}$ exceeds the turn-on voltage $V_{on}$, the control unit 40 does not turn on the first transistors (the first transistor 21*a*, the fourth transistor 21*d*), allowing the counter electromotive force of the coil of the electromagnet 201 and the generator voltage $v_{in}$ to continuously accumulate electric charge in the capacitor 30.

After a lapse of the energy collection time $t_{th2}$, the control unit 40 turns on the first transistors (the first transistor 21*a*, the fourth transistor 21*d*), allowing electric charge accumulated in the capacitor 30 and the generator voltage $v_{in}$ to start a magnetized state of the electromagnet 201.

The generator voltage $v_{in}$ is reduced by the composite operation and the voltage of the capacitor 30 also gradually decreases.

When the voltage of the capacitor reaches the turn-off voltage $V_{off}$ at time $t_8$, the control unit 40 turns off (does not apply the gate voltage of the FET) the first transistors (the first transistor 21*a*, the fourth transistor 21*d*). This prevents the magnet current from passing through the coil of the electromagnet 201, placing the electromagnet 201 into a demagnetized state.

Subsequently, a demagnetized state (charge accumulation by the capacitor 30) and a magnetized state (discharge by the capacitor 30) of the energy collection time $t_{th2}$ are similarly repeated until the end of the switching monitoring time $t_{th1}$. In this case, the energy collection time $t_{th2}$ is kept constant but energy accumulated in the coil of the electromagnet 201 decreases with the passage of time. Thus, a maximum value of the magnet voltage $V_{mag}$ at the end of the energy collection time $t_{th2}$ gradually decreases. However, since the generator voltage $v_{in}$ is not 0 V, the maximum value of the magnet voltage $V_{mag}$ from time $t_6$ does not rapidly decreases unlike in the case where an operator intentionally stops attraction for pieces on the electromagnet 201.

After the lapse of the switching monitoring time $t_{th1}$, the control unit 40 compares the magnet voltage $V_{mag}$ and the switching voltage $v_{th}$. Since the magnet voltage $V_{mag}$ is higher than the switching voltage $v_{th}$, the control unit 40 turns on the first transistors (the first transistor 21*a*, the fourth transistor 21*d*).

The control unit 40 resets the timer of the switching monitoring time $t_{th1}$ and controls the transistors in a magnetized state (normal control).

Thus, the magnet current passes from the rectifier 10 (capacitor 30) through the positive-side power supply line 1*a*, the drain and source of the first transistor 21*a*, the electromagnet 201, the drain and source of the fourth transistor 21*d*, and the negative-side power supply line 1*b*, and then flows into the rectifier 10 (capacitor 30). This magnetizes the coil of the electromagnet 201 and continuously attracts pieces.

As described above, in the electromagnet control apparatus 100 according to the present embodiment, until the end of the switching monitoring time $t_{th1}$ from a transition to the demagnetized state from the magnetized state, the control unit 40 ignores the turn-on voltage $V_{on}$ for turning on the first transistors (the first transistor 21*a*, the fourth transistor 21*d*). The control unit 40 turns on the first transistors after a lapse of the energy collection time $t_{th2}$ that is shorter than the switching monitoring time $t_{th1}$. The demagnetized state and the magnetized state are repeated until the end of the switching monitoring time $t_{th1}$ from the transition to the demagnetized state.

This can achieve the effect of continuously attracting pieces with the core of the magnetized electromagnet 201 without immediately releasing the attracted pieces in a composite operation of the construction machine 200.

Moreover, in the electromagnet control apparatus 100 according to the present embodiment, the control unit 40 turns on the first transistors (the first transistor 21*a*, the fourth transistor 21*d*) if the magnet voltage $V_{mag}$ applied to the electromagnet 201 is equal to or higher than the switching voltage $V_{th}$ at the lapse of the switching monitoring time $t_{th1}$. If the magnet voltage $V_{mag}$ is lower than the switching voltage $V_{th}$, the control unit 40 turns on the second transistors (the second transistor 21*b*, the third transistor 21*c*).

This can achieve the effect of controlling a transition from a magnetized state to a counter-magnetized state or maintenance of a magnetized state in the case where an operator operates the construction machine 200 to stop attraction for pieces (cancel a magnetized state) and in the case where the construction machine 200 performs a composite operation (the generator voltage $v_{in}$ decreases).

REFERENCE SIGNS LIST

1*a* Positive-side power supply line
1*b* Negative-side power supply line
10 Rectifier
20 H-bridge circuit
21 Transistor
21*a* First transistor
21*b* Second transistor
21*c* Third transistor
21*d* Fourth transistor

22 semiconductor diode
22*a* First diode
22*b* Second diode
22*c* Third diode
22*d* Fourth diode
30 Capacitor
40 Control unit
50 AC/DC power supply
51 Capacitor
60 Display
61 Light emitting diode
62 Liquid crystal display
70 Housing
71 Adjustment knob
71*a* On-voltage setting volume
71*b* Off-voltage setting volume
71*c* Delay-time setting volume
71*d* Counter-magnetization time setting volume
71*e* Magnetization limit-time setting volume
72 Mounting stay
73 Mounting bolt hole
74 Heatsink
75 Operation/setting switching button
76*a* Power input connector
76*b* Power output connector
76*c* Contact output connector
76*d* Dummy connector
77 Rubber vibration isolator
100 Electromagnet control apparatus
200 Construction machine
201 Electromagnet
202 Arm
203 Crusher
204 Cab
205 Flow control valve
206 Hydraulic motor
207 Generator

What is claimed is:

1. An electromagnet control apparatus that controls a current to an electromagnet, the electromagnet control apparatus being disposed in a construction machine that is started by operating a hydraulically operating unit with an operating part, the electromagnet control apparatus comprising:

a rectifier connected to a generator that generates power according to a hydraulic pressure of the hydraulically operating unit of the construction machine and configured to convert an alternating voltage applied from a generator into a direct-current voltage;

an H-bridge circuit configured to switch a direction of current to the electromagnet, the H-bridge circuit including four transistors and four semiconductor diodes that are respectively connected to the four transistors between two current-controlling terminals of three terminals of the respective transistors with a forward direction opposite to a direction of a current flowing through the transistors;

a capacitor connected in parallel between the rectifier and the H-bridge circuit and configured to accumulate an electric charge of the direct-current voltage and an electric charge of a counter electromotive force from a coil of the electromagnet; and a control unit that controls a demagnetized state of the electromagnet in which the four transistors of the H-bridge circuit are turned off, a magnetized state of the electromagnet in which first transistors including two of the transistors are turned on, the two transistors being diagonal to each other in the H-bridge circuit, and second transistors including the two other transistors diagonal to each other are turned off, or a counter-magnetized state of the electromagnet in which the first transistors are turned off and the second transistors are turned on, wherein until an end of a first threshold time from a first transition to the demagnetized state from the magnetized state, the control unit performs the steps of:

a) ignoring a turn-on voltage for turning on the first transistors and turning on the first transistors after a lapse of a second threshold time that is shorter than the first threshold time, b) turning off the first transistors once a turn-off voltage is reached that is lower than the turn-on voltage, and c) repeating steps a) and b) until the end of the first threshold time from the first transition to the demagnetized state.

2. The electromagnet control apparatus according to claim 1, wherein the first threshold time is a time that allows continuous attraction for pieces to the electromagnet, and the second threshold time is a time that allows the capacitor to accumulate an electric charge of a counter electromotive force from the coil of the electromagnet.

3. The electromagnet control apparatus according to claim 2, wherein after a lapse of the first threshold time, the control unit turns on the first transistors if a magnet voltage applied to the electromagnet is equal to or higher than a predetermined threshold voltage and the control unit turns on the second transistors if the magnet voltage is lower than the threshold voltage.

4. The electromagnet control apparatus according to claim 3, wherein the threshold voltage is higher than the turn-off voltage for turning off the first transistors and lower than the turn-on voltage for turning on the first transistors.

5. The electromagnet control apparatus according to claim 1, wherein after a lapse of the first threshold time, the control unit turns on the first transistors if a magnet voltage applied to the electromagnet is equal to or higher than a predetermined threshold voltage and the control unit turns on the second transistors if the magnet voltage is lower than the threshold voltage.

6. The electromagnet control apparatus according to claim 5, wherein the threshold voltage is higher than the turn-off voltage for turning off the first transistors and lower than the turn-on voltage for turning on the first transistors.

* * * * *